US009897095B2

(12) United States Patent
Botkin

(10) Patent No.: US 9,897,095 B2
(45) Date of Patent: Feb. 20, 2018

(54) CEILING FAN KIT AND METHOD OF MOUNTING

(71) Applicant: Hunter Fan Company, Memphis, TN (US)

(72) Inventor: Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 344 days.

(21) Appl. No.: 14/702,201

(22) Filed: May 1, 2015

(65) Prior Publication Data

US 2016/0319842 A1 Nov. 3, 2016

(51) Int. Cl.
*F04D 29/64* (2006.01)
*F04D 25/08* (2006.01)
*F04D 29/60* (2006.01)

(52) U.S. Cl.
CPC ..... *F04D 25/088* (2013.01); *F04D 29/601* (2013.01)

(58) Field of Classification Search
CPC .... F04D 25/088; F04D 29/601; F04D 29/646; F16M 13/027
See application file for complete search history.

(56) References Cited

U.S. PATENT DOCUMENTS 481,814 A 8/1892 Overtholt
2,592,315 A 4/1952 Mosley
2,835,520 A 5/1958 Schiring et al.
4,410,160 A * 10/1983 Alperin ..... F04D 29/646 248/342
4,677,273 A 6/1987 Colegrove et al.
4,714,230 A * 12/1987 Huang ..... F04D 25/088 248/343
4,729,725 A 3/1988 Markwardt
4,868,845 A 9/1989 Koropp
4,878,806 A * 11/1989 Markwardt ..... F04D 25/088 416/170 R
4,884,947 A * 12/1989 Rezek ..... F04D 25/088 416/170 R
5,154,579 A 10/1992 Rezek
5,795,220 A * 8/1998 Core ..... F24F 7/007 454/292
5,845,886 A 12/1998 McCormick
5,899,663 A * 5/1999 Feder ..... F04D 25/088 416/5
5,984,640 A * 11/1999 Wang ..... F04D 29/601 248/343
6,030,287 A * 2/2000 Core ..... F04D 25/088 454/292
6,116,559 A 9/2000 Lackey
(Continued)

FOREIGN PATENT DOCUMENTS

TW 148430 12/1990

*Primary Examiner* — Bradley Duckworth
(74) *Attorney, Agent, or Firm* — McGarry Bair PC

(57) ABSTRACT

A ceiling fan kit comprising a structure mount, downrods having differing lengths, and adjustable and non-adjustable length canopies, complementary to the downrods based upon their length. Further, a method of mounting the ceiling fan kit, enabling an installer to quickly and easily adapt the ceiling fan kit to different types or heights of ceilings or building structures without sacrificing aesthetic value or functionality, by utilizing the downrods and their complementary canopies.

22 Claims, 7 Drawing Sheets

(56) References Cited

U.S. PATENT DOCUMENTS 6,120,247 A * 9/2000 Wheeler ..... F04D 25/088 416/1
6,139,279 A 10/2000 Pearce et al.
6,171,061 B1 * 1/2001 Hsu ..... F04D 25/088 416/244 R
6,199,813 B1 * 3/2001 Oliva ..... F04D 25/088 248/342
6,234,757 B1 5/2001 Pearce
6,394,757 B1 5/2002 Lackey
6,443,702 B1 9/2002 Ross
6,558,124 B2 * 5/2003 Bucher ..... F04D 25/088 246/343
6,695,586 B2 2/2004 Lackey
6,872,054 B2 3/2005 Pearce
7,028,963 B1 * 4/2006 Silva ..... F04D 29/601 248/342
7,249,744 B2 * 7/2007 Bacon ..... F04D 29/601 248/343
7,300,248 B2 * 11/2007 Wang ..... F04D 29/601 248/343
7,726,945 B2 6/2010 Grant et al.
8,393,862 B2 * 3/2013 Chen ..... F04D 25/088 415/213.1
8,418,981 B1 * 4/2013 Lowe ..... F04D 25/088 248/222.52
9,593,687 B2 * 3/2017 Iwamoto ..... F04D 25/088
2002/0163812 A1 * 11/2002 Tseng ..... F04D 25/088 362/404
2002/0163813 A1 * 11/2002 Tseng ..... F04D 25/088 362/404
2003/0143073 A1 * 7/2003 Huang ..... F04D 29/668 416/5
2004/0005218 A1 * 1/2004 Marshall ..... F04D 25/088 416/146 R
2005/0006549 A1 * 1/2005 Liu ..... F04D 29/601 248/343
2009/0074587 A1 3/2009 Goswami
2012/0087796 A1 * 4/2012 McMahon ..... F04D 29/34 416/210 R
2013/0076213 A1 * 3/2013 McCloud ..... H02K 5/00 310/75 D
2013/0189109 A1 * 7/2013 Noble ..... F01D 5/02 416/219 R
2015/0090858 A1 * 4/2015 Broughman ..... F04D 25/088 248/674
2016/0102670 A1 * 4/2016 Frampton ..... F04D 25/088 417/424.1
2017/0051759 A1 * 2/2017 Zauhar ..... F04D 25/088

* cited by examiner

CEILING FAN KIT AND METHOD OF MOUNTING

BACKGROUND

The conventional ceiling fan includes a mounting bracket or ceiling plate, which couples to an electric outlet box or the building structure. In a mounting system utilizing a ceiling fan-rated outlet box, machine screws couple the mounting bracket to the outlet box. Alternatively, in a standard electrical outlet box or building structure, wood screws couple the mounting bracket to a wood stud, supporting the ceiling fan. In either event, the screws are tightened until a structure mount is securely mounted to the building structure.

A typical ceiling fan assembly comprises, a motor, a motor housing, a plurality of fan blades, a canopy, and an optional light assembly, which secures to the ceiling plate or mounting bracket by a downrod or a hanger rod. The downrod passes through a central opening in the canopy. One end of the downrod couples to a downrod coupler for mounting to the mounting bracket while the opposite end of the downrod mounts to the ceiling fan assembly, utilizing a motor coupler. A ball attaches to the downrod coupler and is received in a seat formed in the mounting bracket, mounting the ceiling fan assembly to the mounting bracket, and thus the ceiling fan unit to the ceiling.

Traditionally, ceiling fans are sold with a single mounting style being either a low-profile mount, a traditional-profile mount, or a high or angled profile mount. A low-profile mount mounts the ceiling fan close to the ceiling, reducing the chance of collision with the fan blades during operation. When utilizing a low-profile mount, the canopy typically extends from the fan motor housing to the ceiling, completely covering the downrod. Conversely, in a traditional-profile or high profile mount, the downrod is visible, with a canopy that extends from the ceiling down to a portion of the downrod creating an aesthetic transition between the two. A traditional-profile mount or a high profile mount extend further from the ceiling, as compared to a low-profile mount, in order to optimize fan efficiency by increasing space above the fan promoting greater airflow.

Consumers purchase mounting styles based upon the consumer's ceiling in order to optimize fan efficiency, maintain safety, and promote aesthetic value. A consumer with a low height ceiling, generally less than 8 feet, will be limited to purchasing a low-profile mount ceiling fan to accommodate the low ceiling. A consumer with a normal height ceiling, generally 8 to 10 feet, will be limited to purchasing a traditional-profile ceiling fan to optimize fan efficiency. Finally, a consumer with a high, vaulted, or angled ceiling, extending higher than 10 feet, will purchase a ceiling fan specifically accommodating the specific ceiling style, such as a ceiling fan with high-profile mount utilizing an elongated downrod.

If a consumer wants to purchase a ceiling fan style specifically designed for a traditional-profile mount, but has a low-profile ceiling, the consumer will have to worry about the low hanging fan blades. Furthermore, if a consumer moves to another home with a different height ceiling or wants to move the ceiling fan to another room with a different height ceiling, the ceiling fan will have an incorrect mounting profile to accommodate new room. Transitioning ceiling fans between different heights or finding a ceiling fan style specific to a ceiling type often limits a consumer in purchasing and style options.

Additionally, installing the ceiling fan while making internal, electrical wiring connections is difficult. Holding the ceiling fan assembly while making connections is challenging. In a low-profile mount, the canopy extends from the fan assembly to the ceiling, creating a situation where the size of the canopy prevents an installer from making internal electrical connections. Installation requires an installer to hold the ceiling fan assembly while simultaneously making mounting or electrical connections, making the endeavor at least a two-person job and raising issues with safety.

BRIEF SUMMARY

A ceiling fan kit with a first downrod, a second downrod being longer than the first downrod, a structure mount configured to attach either downrod to a structure, an adjustable length canopy configured for use with the first downrod, and a non-adjustable length canopy configured for use with the second downrod. The adjustable length canopy is extendable and retractable and may provide a low-profile ceiling mount when used in conjunction with the first downrod. The non-adjustable canopy may provide a traditional-profile mount when used in conjunction with the second downrod. The extended length of the adjustable length canopy may be a greater length than the first downrod and the non-adjustable length canopy. The non-adjustable length canopy may be of a length less than the length of the second downrod. The structure mount may comprise a mounting bracket.

The kit may comprise additional elements such as fan motor assembly including at least one fan blade, and a downrod coupler for retaining either downrod. The downrod coupler may comprise a ball mount for coupling to either downrod, where the mounting bracket may retain the ball.

A method of installing a ceiling fan comprising the steps of: (A) selecting a downrod from at least a first downrod and a second downrod, where the second downrod is longer than the first downrod; (B) selecting a canopy from either an adjustable length or a non-adjustable length canopy based on the selected downrod; (C) mounting the selected downrod to a downrod coupler; (D) positioning the selected canopy about the selected downrod; (E) mounting the downrod to a fan assembly; and (F) mounting the downrod coupler to a structure mount. The method may further comprise securing the downrod coupler to the structure mount.

When the adjustable length canopy is selected, the method may further comprise extending the length of the adjustable length canopy after securing the downrod coupler to the structure mount and securing the adjustable length canopy to the structure mount after extending the length. Securing the downrod coupler to the structure mount may include placing a ball on the downrod coupler within a complementary seat on the structure mount. The adjustable length canopy may include telescoping segments.

When selecting the non-adjustable length canopy, the method may further comprise sliding the non-adjustable length canopy along the selected downrod until a portion of the non-adjustable length canopy is adjacent to the structure mount or securing the portion of the non-adjustable length canopy to the structure mount.

The method may further comprise selecting the adjustable length canopy when the selected downrod is the first downrod or selecting a non-adjustable length canopy when the selected downrod is the second downrod.

DETAILED DESCRIPTION

Figure 1:
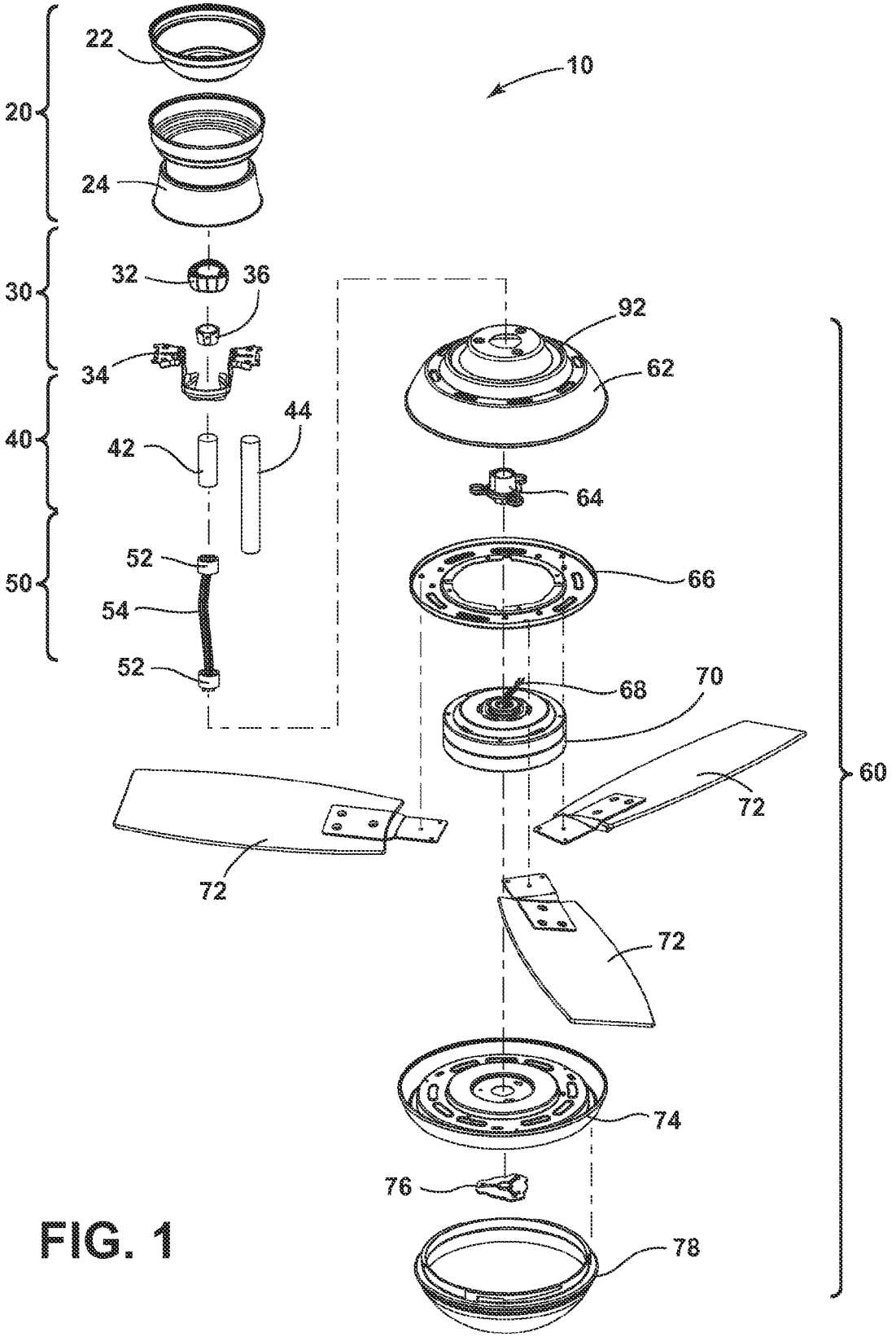
FIG. 1 depicts an exploded view of an embodiment of a ceiling fan kit.

Turning now to the drawings and to FIG. 1 in particular, one combination of combinable ceiling fan parts comprising elements of a kit are shown. FIG. 1 is non-limiting, showing one set of combinable elements, comprising a kit, which may contain more or less elements than what is illustrated and described. The kit comprises general modular fan assembly elements, many of which are exchangeable for other elements with different designs, quantities, qualities, or functionalities.

The ceiling fan kit 10 shown comprises a modular fan assembly 60, wiring harness 50, downrod set 40, mounting assembly 30, and canopy set 20. The modular fan assembly 60 comprises a motor 70, including motor wires 68, blade mounting ring 66, which mounts a plurality of fan blades 72. The upper motor housing 62, with a canopy rest 92 situated on an outer surface, and lower motor housing 74 enclose the motor 70 while leaving an annular opening through which the fan blades 72 extend. A motor coupler 64 mounts to an upper end of the motor 70, and a motor coupler brace 76 mounts to a lower end of the motor 70. A light globe or shade 78 mounts to the lower end of the lower motor housing 74.

The downrod set 40 comprises a short downrod 42 and a long downrod 44. The long downrod 44 can be a downrod of any length being greater than the length of the short downrod 42. The short downrod 42 is suitable for a low profile mounting of the motor 70 to the ceiling, whereas the long downrod 44 may be suitable for a traditional-profile mounting, high-profile mounting, or mounting the motor 70 to an angled or vaulted ceiling. While two downrods are shown, more than two downrods having differing lengths may be included in the downrod set 40.

The wiring harness 50 includes wiring 54, which can terminate on one or more ends with a connector 52. The connector 52 can be preassembled to the wiring 54 or can be ready for assembly by the installer. In either case, the connector 52 may be a push connector having multiple slots or openings in which the leads of the wiring 54 may be pushed in to establish an electrical connection between the wiring 54 and the connector 52. Further, the ceiling fan kit 10 may comprise a set of harnesses, complementary to each downrod in the downrod set 40. Harnesses may be pre-installed within each downrod or may require installation. Still further, the ceiling fan kit 10 may have no wiring harness 50 or may include a length of wire that can be stripped and cut to electrically couple the motor 70 to the structure power supply.

The mounting assembly 30 comprises a structure mount 34, downrod coupler 36, and a ball 32. The structure mount 34 can be mounted to the ceiling or other structure to which the motor 70 is to be mounted. A portion of the structure mount 34 forms a seat adapted to receive the ball 32. The ball 32 couples to the downrod coupler 36, which couples to the selected downrod 42, 44. The ball 32, upon resting in the seat, can provide for pivoting movement of the downrod 42, 44 relative to the structure mount 34. The ball 32 can have a tri-lobe configuration to improve the seating and pivoting movement relative to the structure mount 34.

The canopy set 20 can comprise a non-adjustable length canopy 22, best suited for a traditional mounting, and an adjustable length canopy 24, best suited for a low profile mounting. While two canopies are shown in the canopy set 20, more than two canopies may be included in the canopy set 20.

The elements of the ceiling fan kit 10 are interconnectably combinable, as shown in FIG. 1, to form a ceiling fan structure, which is mountable to a building structure having electrical connectivity. As may be appreciated, different combinations of the downrods 42, 44 and the canopies 22, 24 may be selected such that either a low-profile mounting or a traditional-mounting of the motor 70 to the structure mount 34 can be accomplished without the need for abandoning the structure mount 34 in the low profile mounting or having a special structure mount 34 for each of the low-profile and traditional-profile mounting. More specifically, the short downrod 42 and the adjustable length canopy 24 may be combined to create a ceiling fan structure having a low-profile mount or the long downrod 44 and the non-adjustable length canopy 22 may be combined to create a ceiling fan structure having a traditional-profile mount. In further ceiling fan kits 10, any number or variety of downrods may be included, being complementary to any number or variety of canopies, accommodating a variety of ceiling heights or building structures, including but not limited to, low heights ceilings, normal height ceilings, high ceilings, or vaulted or angled ceilings as well as building beams, rafters, or supports or any other building structure of which it may be desirable to mount a fan.

Figure 2:
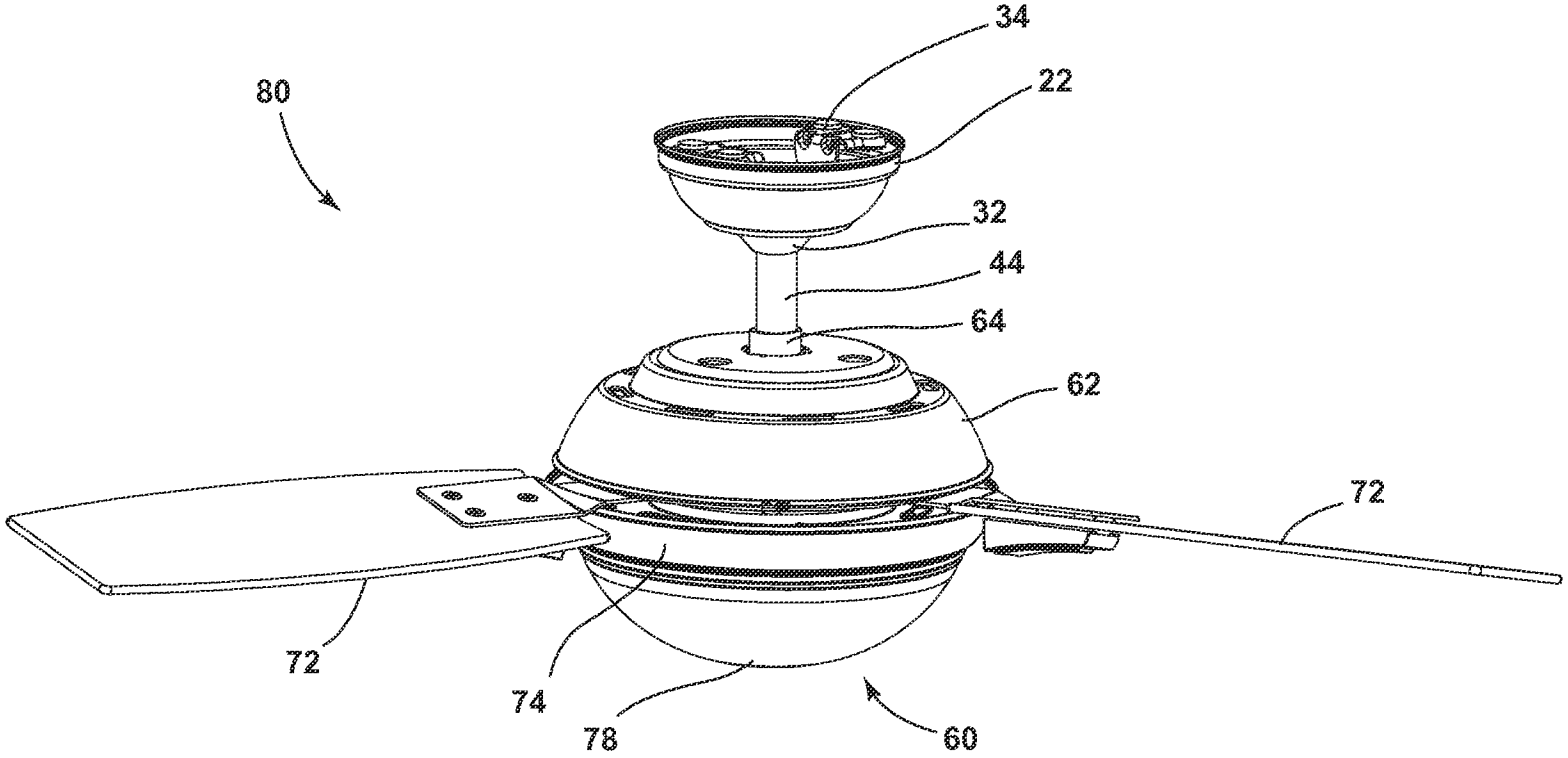
FIG. 2 depicts a perspective view of an embodiment of an assembled ceiling fan with a non-adjustable length canopy.

Turning now to FIG. 2, selected elements from the ceiling fan kit 10 are shown assembled into a traditional-profile assembly 80. More specifically, the long downrod 44 and the non-adjustable length canopy 22 are selected by the installer and then combined with the other elements to form the traditional-profile assembly 80. The modular fan assembly 60 has been combined and is mounted to the long downrod 44 at the motor coupler 64.

The mounting assembly 30 has been combined. The downrod coupler 36 couples the end of the long downrod 44, opposite of the modular fan assembly 60, to the ball 32. The ball 32 is seated in the structure mount 34, mounting the modular fan assembly 60 to the ceiling. The non-adjustable length canopy 22 positions around and attaches to the structure mount 34, resting flush against the ceiling.

Figure 3:
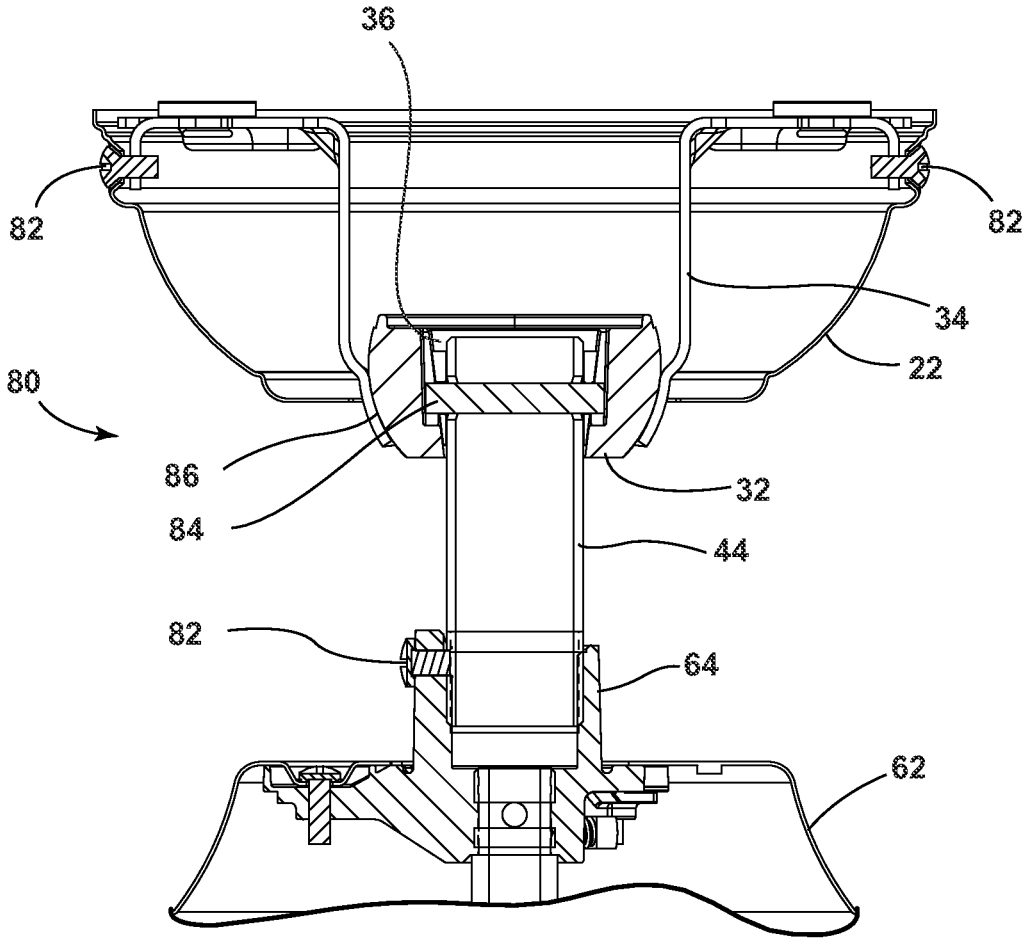
FIG. 3 depicts a detailed view of the ceiling fan mounting components of FIG. 2.

The coupling of the long downrod 44 between the structure mount 34 and the modular fan assembly 60 is best shown with respect to FIG. 3, which is a section view of an upper portion of the traditional-profile assembly 80. The modular fan assembly 60 couples to the long downrod 44 by the motor coupler 64 utilizing a screw 82. The inner surface of the upper motor housing 62 rests on top of a portion of the motor coupler 64 situated inside of the upper motor housing 62.

Opposite of the motor coupler 64, the long downrod 44 mounts to the downrod coupler 36 with a pin 84. The ball 32 is adapted to receive and support the downrod coupler 36 such that the downrod coupler 36 rests on a ledge extending into an internal recess within the ball 32. The structure mount 34 has a seat 86 adapted to receive the ball 32. Upon attaching the structure mount 34 to the ceiling and positioning the ball 32 within the seat 86, the structure mount 34 couples the other combined elements comprising the ceiling fan kit 10 to the ceiling.

Figure 4:
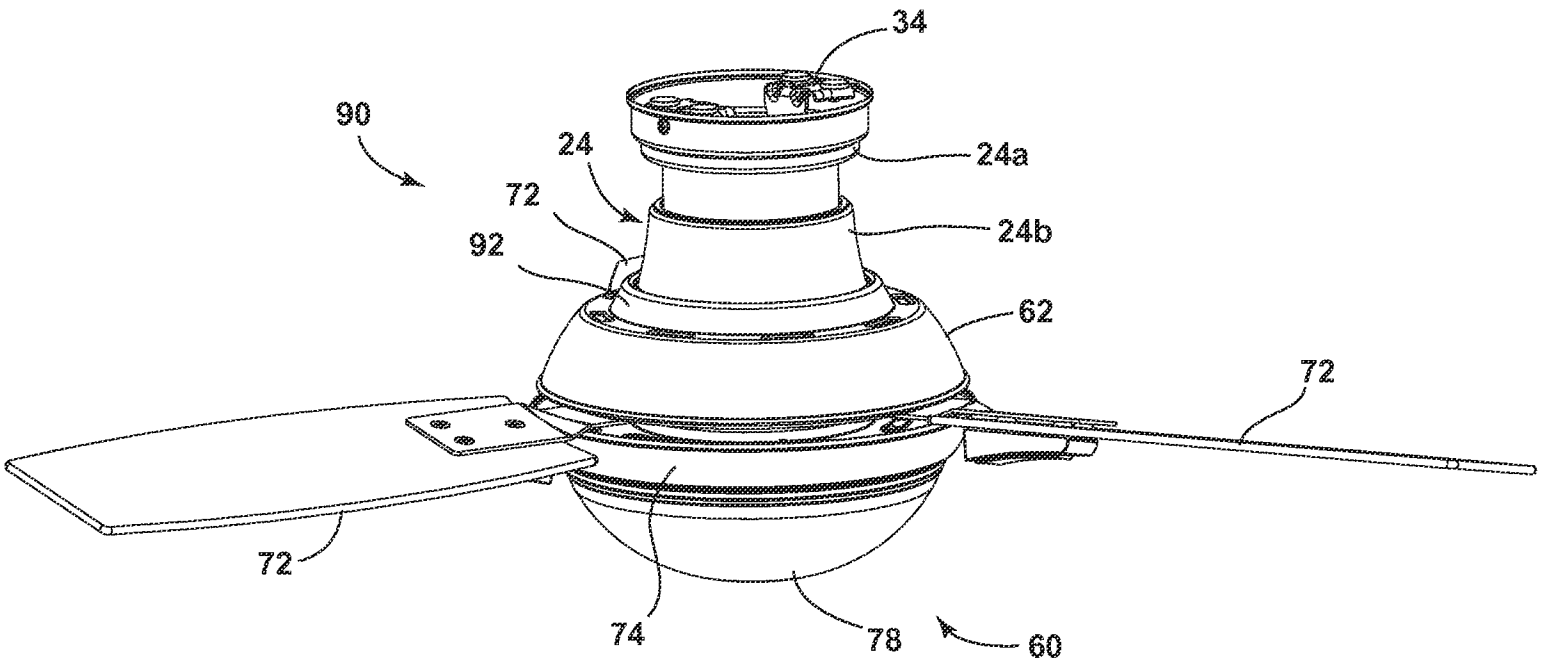
FIG. 4 depicts a perspective view of an embodiment of an assembled ceiling fan with an adjustable length canopy.

Turning now to FIG. 4, selected elements from the ceiling fan kit 10 are shown assembled into a low-profile assembly 90. Specifically, the short downrod 42 and the adjustable length canopy 24 are selected by the installer and then combined with the other elements to form the low-profile assembly 90. The modular fan assembly 60 is combined in the same manner for mounting to the ceiling as in FIG. 2, regarding the installation of a traditional-profile assembly 80.

The adjustable length canopy 24 extends between the upper motor housing 62 and the structure mount 34, while enveloping the structure mount 34 and short downrod 42, to effectively fill in any gap between the upper motor housing 62 and the structure to which the upper motor housing 62 is mounted. In this manner, the adjustable length canopy 24 provides a cover for the short downrod 42, unlike the non-adjustable length canopy 22 in the traditional-profile mounting.

The adjustable length canopy 24 is comprised of two separate elements including an upper member 24*a* and a lower member 24*b*, which may be moved relative to each other between an extended position (FIG. 5) and a retracted position (FIG. 6), which aids in the mounting of the upper motor housing 62 to the structure during installation. While the adjustable length canopy shown in FIGS. 5 and 6 is comprised of two separate elements, the adjustable length canopy may consist of more than two elements configured in a similar telescoping arrangement.

Figure 5:
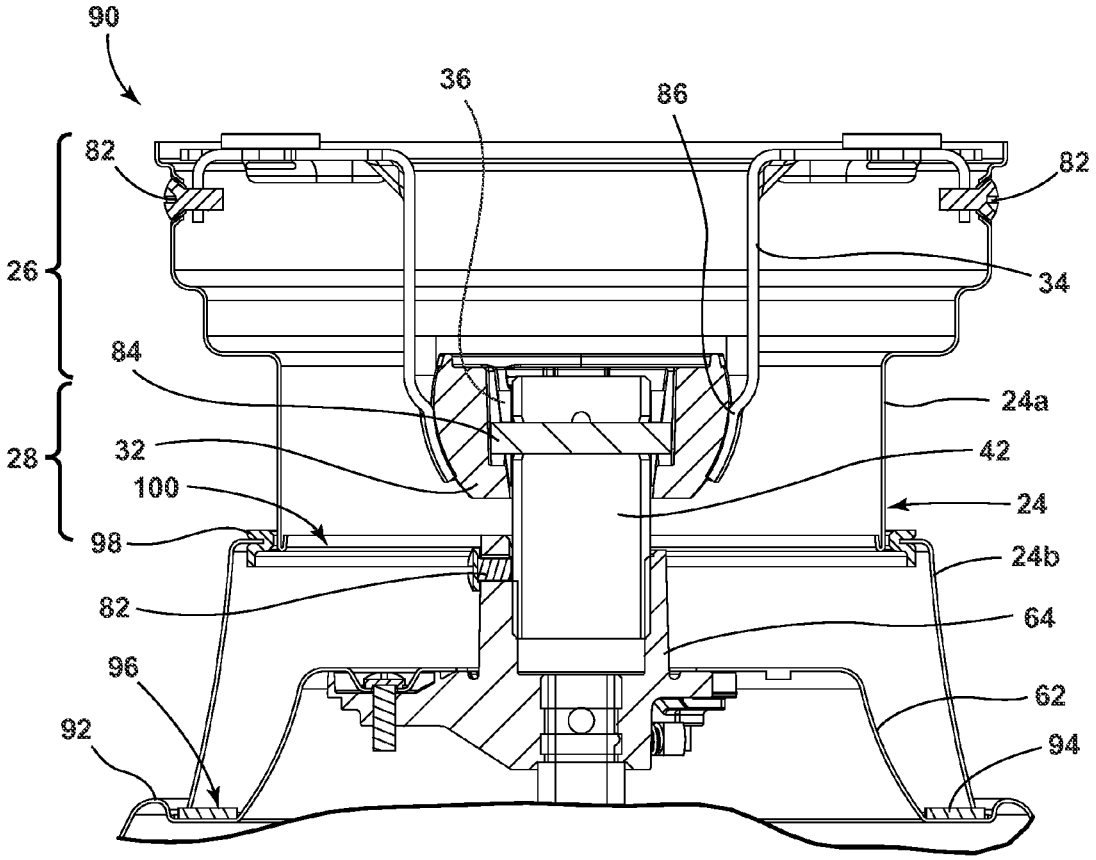
FIG. 5 depicts a detailed view of the ceiling fan mounting components of FIG. 4 with an extended adjustable length canopy.
Figure 6:
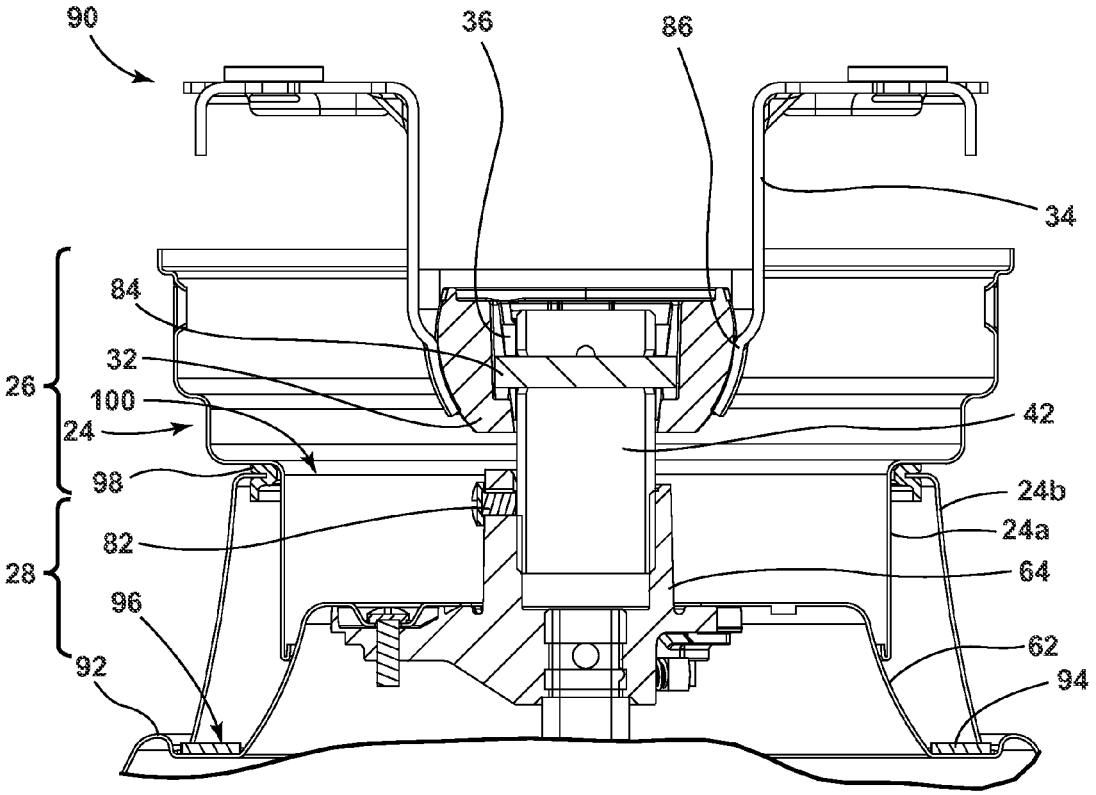
FIG. 6 depicts a detailed view of the ceiling fan mounting components of FIG. 4 with a retracted adjustable length canopy.

The structure of the adjustable length canopy 24 is best seen with reference to FIG. 5. The upper member 24*a* has a stepped portion 26 having a series of reduced diameter portions, providing a step-like appearance, which transition to a smallest reduced diameter portion being identified as reduced portion 28. The lower member 24*b* terminates in an opening 100 in which is received by an annular spacer 98, which can be an absorption member to attenuate vibrations. The reduced portion 28 passes through the opening 100 to telescopically connect the upper member 24*a* and lower member 24*b*. In the retracted position (FIG. 6), the stepped portion 26 will abut the lower member 24*b* and function as a stop to limit the telescopic movement in the retracted position. As illustrated, the reduced portion 28 does not have a structure that would prevent removal of the reduced portion 28 from the opening 100; however, such a structure, like an angular flange, could be provided.

Still referring to FIG. 5, the mounting of the modular fan assembly 60 to the structure mount 34 using the short downrod 42 is similar to that described and shown in FIG. 3 for the long downrod 44. In the low-profile assembly 90, using the short downrod 42, the motor coupler 64 couples the modular fan assembly 60 to the short downrod 42 utilizing the upper motor housing 62 in the same manner as the modular fan assembly 60 may be coupled to the long downrod 44 as in FIG. 3. Furthermore, the short downrod 42 couples to the mounting assembly 30 in same manner as the long downrod 44 couples to the mounting assembly 30 as detailed in the discussion of FIG. 3 as well.

Unlike the traditional-profile assembly 80, in the low-profile assembly 90, the lower member 24*b* of the adjustable length canopy 24 rests on the canopy rest 92. The canopy rest 92 has a groove 96 with pad 94 situated in the bottom of the groove 96. The groove 96 runs circumferentially around canopy rest 92 having a diameter adapted to receive the bottom edge of the lower member 24*b*. The pad 94 can be an absorption member used to attenuate the transfer of vibrational forces between the modular fan assembly 60 and the adjustable length canopy 24.

When in the extended position, the upper member 24*a* of the adjustable length canopy 24 can be coupled to the structure mount 34 by screws 82. In the extended position, the adjustable length canopy 24 surrounds the structure mount 34, the ball 32, the downrod coupler 36, and a portion of the short downrod 42. In the extended position, the bottom edge of the reduced portion 28 of the upper member 24*a* is situated within the internal recess of the lower member 24*b*.

Turning now to FIG. 6, in the retracted position, the upper member 24*a* is no longer attached to the structure mount 34, making it possible for the reduced portion 28 to slide into the lower member 24*b*. The stepped portion 26 rests on the spacer 98, atop the upper rim of the lower member 24*b*, to limit the amount the reduced portion 28 may be slid into the lower member 24*b*. In the retracted position, external access to the internal recess of the structure mount 34 and the ball 32 is available for ease of installation.

The method of mounting the ceiling fan kit 10 of FIG. 1 to the ceiling comprises selecting one downrod 42, 44 from the downrod set 40 and selecting one canopy 22, 24 from the canopy set 20 based upon the selected downrod 42, 44. The structure mount 34 is attached to the ceiling. The wiring harness 50 is inserted within the selected downrod 42, 44, which mounts to the downrod coupler 36. The ball 32 slides up the selected downrod 42, 44 until it abuts the downrod coupler 36.

The modular fan assembly 60 is combined such that the motor wires 68 extend out of the motor coupler 64. Opposite of the downrod coupler 36, one connector 52 of the wiring harness 50, extending from inside the selected downrod 42, 44, couples to the motor wires 68 and the selected downrod 42, 44 couples to the motor coupler 64. The other connector 52 of the wiring harness 50 extends through and out of the ball 32.

The selected canopy 22, 24 is positioned about the selected downrod 42, 44. If the selected canopy 22, 24 is the non-adjustable length canopy 22, it may be slid down the selected downrod 42, 44 until abutting the modular fan assembly 60. If the selected canopy is the adjustable length canopy 24, the lower member 24*b* rests on the canopy rest 92 within the groove 96, while the reduced portion 28 of the upper member 24*a* is telescopically slid within the lower member 24*b*. In either case, after positioning the selected canopy 22, 24, the ball 32 is positioned within the seat 86 of the structure mount 34, mounting the downrod coupler 36 to the structure mount 34. The connector 52 extending through the ball 32 couples the wiring 54 to an electrical supply, providing electrical connectivity to the motor 70.

If the selected canopy 22, 24 is the non-adjustable length canopy 22, it is slid up the selected downrod 42, 44 and coupled to the structure mount 34, covering the structure mount 34 and resting flush against the ceiling. If the selected canopy 22, 24 is the adjustable length canopy 24, most of the upper member 24*a* is telescopically slid out of the lower member 24*b*, while remaining only partially within the lower member 24*b*, and couples to the structure mount 34, covering the structured mount 34 and resting flush against the ceiling.

Figure 7:
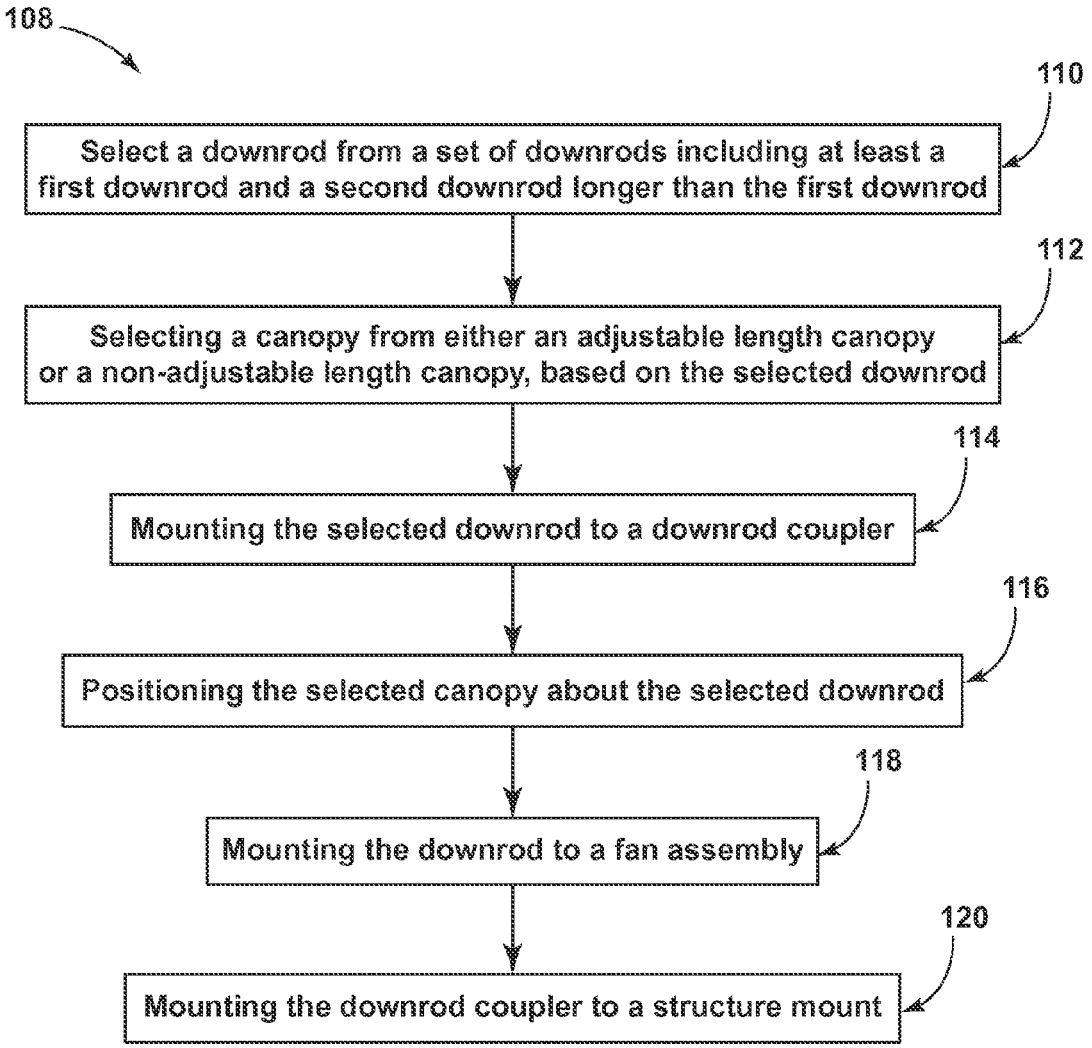
FIG. 7 depicts a flow chart of steps comprising a method of mounting the kit of FIG. 1.

Turning now to FIG. 7, a flowchart depicting the steps comprising a method 108 of mounting the ceiling fan kit is shown. At 110, an installer selects a downrod from a set of downrods including at least a first downrod and a second downrod where the second downrod is longer than the first. At 112, the installer selects a canopy based on the selected downrod from 110. The selected canopy of 112 is selected from a set of canopies including at least one adjustable length canopy and on non-adjustable length canopy.

At 114, the installer mounts the selected downrod to a downrod coupler, and, at 116, the installer positions the selected canopy about the selected downrod. At 118, the installer mounts the selected downrod to a fan assembly and at 120, the installer mounts the downrod coupler to a structure mount. In additional methods for mounting the ceiling fan kit, 116 and 118 may be completed in any order as a particular fan assembly may require. The fan assembly of 118 can be the combined modular fan assembly 60 of FIG. 1. The structure mount of 120 can be already attached to the ceiling, where mounting the downrod coupler to the structure mount, mounts the fan assembly to the ceiling.

The method 108 of mounting the kit, may comprise selecting the first downrod at 110 and selecting the adjustable length canopy at 112, wherein mounting the first downrod and adjustable length canopy in 114 through 120 comprises a low-profile mount. The method 108 may also comprise selecting the second downrod at 110 and selecting the non-adjustable length canopy at 112, wherein mounting the second downrod and the non-adjustable length canopy in 114 through 120 comprises a traditional-profile mount.

In the aforementioned, ceiling fan elements or combinations thereof are accommodating of either downrod 42, 44, and either canopy 22, 24 in any combination utilizing at least one downrod 42, 44 and at least one canopy 22, 24. The elements of the downrod set 40 and the canopy set 20 are modularly interchangeable with other elements of the ceiling fan kit 10.

The ceiling fan kit as previously described may come in different configurations. For example, one configuration that is suitable when the fan assembly is not needed, may have a first downrod and second downrod longer than the first, adjustable and non-adjustable length canopies, and a structure mount. In another configuration, the ceiling fan kit can include just an adjustable length canopy, which is extendable between a retracted and an extended length, and the shorter downrod, which kit would be suitable for a low-profile mount. In such a configuration, the adjustable length canopy may comprise telescoping segments. The adjustable length canopy may have an extended length that is greater than the length of the shorter downrod.

Any of the kit configurations may further include a downrod coupler to retain a first end of either downrod to the structure mount. The downrod coupler may comprise a ball, mounting a first end of either downrod. The structure mount may be configured to mount to a structure and further comprise a mounting bracket to retain the ball.

Any of the kit configurations may further comprise a fan motor assembly to securely mount to a second end of the either downrod, opposite of the first end. The fan motor assembly may comprise at least one fan blade configured to mount to the fan motor.

The method of mounting the ceiling fan kit, consists of steps comprising selecting a downrod from at least a first downrod and a second downrod being longer than the first, selecting either an adjustable length canopy or nonadjustable length canopy based upon selection of the downrod, mounting the selected downrod to a downrod coupler, positioning the selected canopy about the selected downrod, and mounting the downrod to a fan assembly. The aforementioned method is but one method for mounting the ceiling fan kit, and has natural variations comprising steps in varying orders or combinations, or including additional steps.

In one variation, the method may comprise selecting the adjustable length canopy when the selected downrod is the first downrod. In another, the method may comprise selecting the non-adjustable length canopy when the selected downrod is the second downrod.

In a further variation, the method may comprise securing the downrod coupler to a structure mount. Securing the downrod to a structure mount may comprise placing a ball on the downrod coupler and within a complementary seat in the structure mount. The method may further comprise securing the selected canopy to the structure mount.

In another variation where the selected canopy is the adjustable length canopy, the method may further comprise extending the length of the canopy after securing the downrod coupler to the structure mount. Extending the length of the canopy may comprise extending telescoping segments of the adjustable length canopy. The adjustable length canopy can be secured to the structure mount after extending the length.

In yet another separate variation, where the non-adjustable length canopy is selected, the non-adjustable length canopy can be slid along the selected downrod until a portion of the non-adjustable length canopy is adjacent to the structure mount. Further, the non-adjustable length canopy can be secured to the structure mount.

As may be appreciated, this ceiling fan kit and method of mounting thereof solves problems associated with installing a ceiling fan designed for a specific ceiling height on another ceiling height. Additionally, an installer wishing to move a ceiling fan from one ceiling to another will be able to do so quickly and efficiently, regardless of differences among ceiling heights or designs. Having multiple selectable downrods as well as complementary canopies gives the installer options for different ceiling types rather than a single ceiling type.

Additionally, problems associated with using a non-adjustable canopy in a low profile environment are solved utilizing an adjustable length canopy, enabling easy internal electrical or mechanical connections to be made without interference from the canopy. The adjustable length canopy enables an installer to extend or retract the canopy for installation purposes, such as mechanical or electrical connections, while maintaining an aesthetically pleasing cover over the structure mount, ceiling hole, and electrical box after installation.

It should be understood that as used herein the term "ceiling" of a structure is intended to include not only the conventional ceiling of a building or house, but also any other structure, which can support a ceiling fan such as an exposed beam, post, or the like.

While the invention has been described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

The invention claimed is:

1. A ceiling fan mounting kit for mounting a ceiling fan motor housing with a motor coupler to a structure, the ceiling fan mounting kit comprising:

a first downrod having a first fixed length and configured to mount to the motor coupler;

a second downrod having a second fixed length longer than the first fixed length and configured to mount to the motor coupler;

a structure mount configured to mount either of the first and second downrods to the structure;

an adjustable length canopy configured for use with the first downrod; and a non-adjustable length canopy configured for use with the second downrod;

wherein the first downrod and the adjustable length canopy are used in a low-profile mounting and the second downrod and non-adjustable length canopy are used in a traditional-profile mounting.

2. The ceiling fan mounting kit of claim 1 wherein the adjustable length canopy is extendable between a retracted length and an extended length.

3. The ceiling fan mounting kit of claim 2 wherein the extended length is greater than the first fixed length of the first downrod.

4. The ceiling fan mounting kit of claim 3 wherein a length of the non-adjustable length canopy is less than the extended length of the adjustable length canopy.

5. The ceiling fan mounting kit of claim 4 wherein the length of the non-adjustable length canopy is less than the second fixed length of the second downrod.

6. The ceiling fan mounting kit of claim 1 further including a downrod coupler selectively retaining either the first downrod or the second downrod.

7. The ceiling fan mounting kit of claim 6 wherein the downrod coupler comprises a ball mounting a first end of either the first downrod or the second downrod.

8. The ceiling fan mounting kit of claim 7 wherein the structure mount further comprises a seat adapted to retain the ball.

9. The ceiling fan mounting kit of claim 8 further comprising a fan motor assembly mounting to either the first or second downrod at the motor coupler.

10. The ceiling fan mounting kit of claim 9 further comprising at least one fan blade configured to mount to the fan motor assembly.

11. The ceiling fan mounting kit of claim 1 wherein the adjustable length canopy comprises telescoping segments.

12. A method of mounting a ceiling fan to a structure, the method comprising:

selecting a downrod from at least a first downrod having a first fixed length and a second downrod having a second fixed length which is longer than the first fixed length for the first downrod;

selecting a canopy from either an adjustable length canopy or a non-adjustable length canopy based on the selected downrod;

mounting the selected downrod to a downrod coupler;

positioning the selected canopy around the selected downrod;

mounting the selected downrod to a fan assembly with a motor coupler opposite of the downrod coupler; and mounting the downrod coupler to a structure mount.

13. The method of claim 12 wherein mounting the downrod coupler to the structure mount further comprises securing the downrod coupler to the structure mount.

14. The method of claim 13 wherein when the selected canopy comprises the adjustable length canopy, further comprising extending the adjustable length canopy after securing the downrod coupler to the structure mount.

15. The method of claim 14 further comprising securing the adjustable length canopy to the structure mount after the extending the adjustable length canopy.

16. The method of claim 14 wherein extending the adjustable length canopy comprises extending telescoping segments of the adjustable length canopy.

17. The method of claim 13 wherein securing the downrod coupler to the structure mount comprises placing a ball on the downrod coupler within a complementary seat on the structure mount.

18. The method of claim 13 wherein when the selected canopy comprises the non-adjustable length canopy, sliding the non-adjustable length canopy along the selected downrod until a portion of the non-adjustable length canopy is adjacent the structure mount.

19. The method of claim 18 further comprising securing the portion of the non-adjustable length canopy to the structure mount.

20. The method of claim 13 further comprising securing the selected canopy to the structure mount.

21. The method of claim 12 wherein selecting the canopy comprises selecting the adjustable length canopy when the selected downrod is the first downrod.

22. The method of claim 12 wherein selecting the canopy comprises selecting the non-adjustable length canopy when the selected downrod is the second downrod.

* * * * *